United States Patent [19]

Unverferth

[11] 4,069,133

[45] Jan. 17, 1978

[54] APPARATUS AND PROCESS FOR REDUCING PARTICULATES IN A VAPOROUS STREAM CONTAINING CONDENSABLE HYDROCARBONS

[75] Inventor: Jack W. Unverferth, Walnut Creek, Calif.

[73] Assignee: Chevron Research Company, San Francisco, Calif.

[21] Appl. No.: 700,260

[22] Filed: June 25, 1976

[51] Int. Cl.[2] ..... C10G 1/02

[52] U.S. Cl. ..... 208/11 R; 208/8; 201/4; 202/117; 202/118; 202/254

[58] Field of Search ..... 208/8, 11 R; 201/4, 201/24; 202/117, 118, 254

[56] References Cited

U.S. PATENT DOCUMENTS

| | | | |
|---|---|---|---|
| 3,004,898 | 10/1961 | Deering | 208/11 R |
| 3,658,654 | 4/1972 | Gutberlet | 208/11 R |

FOREIGN PATENT DOCUMENTS

| | | | |
|---|---|---|---|
| 536,190 | 10/1931 | Germany | 201/4 |

*Primary Examiner*—Delbert E. Gantz
*Assistant Examiner*—James W. Hellwege
*Attorney, Agent, or Firm*—D. A. Newell; R. H. Davies; J. J. DeYoung

[57] ABSTRACT

Disclosed is a process and apparatus for reducing the particulate content in a gaseous stream containing entrained particulate matter and condensable hydrocarbons wherein said stream is obtained from the retorting of hydrocarbon-containing solids, particularly from retorted shale. A gaseous effluent containing condensable hydrocarbons and entrained solid particulate matter is produced during the retorting of hydrocarbon-containing solids and is discharged from a retorting vessel through a conduit containing a rotating elongate spiral-shaped element on which a portion of the particulate matter and condensable hydrocarbons form a semi-solid mass. The rotating spiral collects and conveys the semi-solid mass back into the retorting vessel for further processing thereby reducing the solid particulate content of the condensable hydrocarbon product.

7 Claims, 3 Drawing Figures

APPARATUS AND PROCESS FOR REDUCING PARTICULATES IN A VAPOROUS STREAM CONTAINING CONDENSABLE HYDROCARBONS

BACKGROUND OF THE INVENTION

This invention relates to the gasification of hydrocarbon-containing solids, particularly retorted shale.

It is known in the art to use destructive distillation, pyrolysis or retorting to extract hydrocarbons from hydrocarbon-containing solids such as shale, coal, tar sands, etc. In the case of coal or shale, the solids are first crushed and then heated by various means to an elevated temperature typically in the range of 700° to 1400° F or higher in a retorting vessel to drive off or liberate the hydrocarbons contained in the solid. During the mining of hydrocarbon-containing solids and particularly during the subsequent crushing of the solids for retorting, finely-divided solids are formed which frequently tend to end up in the product oil.

Because large quantities of shale must be processed to produce limited amounts of shale oil, most retorting processes are designed to operate on a continuous basis and thereby involve the movement of large quantities of solids. Processes for the continuous retorting of shale to produce oil have a common problem in that the product contains varying concentrations of mineral particulate matter. This particulate matter leaves the retorting vessel as a fine dust entrained in the product vapor or mist. In the condensed oil, this particulate matter leads to a difficult separation and quality control problems. Once the product plus entrained particulate matter contacts a surface whose temperature is below the boiling point of the product, a viscous, sticky, semi-solid mass tends to build up on the surface. The deposit has a significant (20–40%) organic content thus reducing yields. Furthermore, if this semi-solid deposit is allowed to accumulate it ultimately plugs the retort outlet orifice and downstream conduits and process equipment.

The problem of particulate matter in the product oil is further complicated in retorting processes wherein a stripping gas is passed over or through the hydrocarbon-containing solids. The added flow of the stripping gas tends to increase the quantity of entrained particulate matter and thus further increases the solids content problem in the condensed oil.

In some prior art processes, as shown for example in U.S. Pat. No. 3,784,462, one partial solution to the dust problem has been to enclose cyclone separators within the retorting vessel. In other processes, hot cyclones or electrostatic precipitators located outside of the gasification vessel are used to separate the particulate matter prior to condensation of the oil. However, the cyclones and electrostatic precipitators must be operated at very high temperatures and the product stream must be maintained at or above the highest temperature attained during the retorting process to prevent any condensation and accumulation of solids on processing equipment. However, maintaining the effluent stream at high temperatures is expensive from an energy standpoint and allows detrimental side reactions to continue, such as cracking, coking and polymerization, which tends to decrease the yield and quality of the desired normally liquid hydrocarbons.

The present invention involves the use of a rotating spiral-shaped conveyor in at least one gaseous discharge conduit of a gasification vessel, particularly a shale retorting vessel. The use of helical conveyors in conjunction with retorting vessels is old in the art. For example, helical and screw type conveyors have long been used to feed raw shale into retorting vessels as is shown, for example, in U.S. Pat. No. 2,664,389. Also, screw type conveyors have been used as the conveying means for transporting solids through retorting vessels as shown, for example, in U.S. Pat. No. 1,388,718. Similarly, helical shaped conveying devices have been used to remove retorted shale from retorting vessels as is shown, for example, in U.S. Pat. No. 1,475,901.

SUMMARY OF THE INVENTION

In a continuous process for the production of condensable synthetic hydrocarbons from hydrocarbon-containing solids including gasifying said solids in a vessel forming a gaseous stream containing condensable hydrocarbons and entrained solid particulate matter, the improvement which comprises removing a portion of the particulate matter from said stream by discharging said stream from said vessel through a conduit containing an elongate spiral-shaped element whereby a portion of said particulate matter and a portion of said condensable hydrocarbons form a semi-solid mass in said conduit, and conveying at least a portion of said semi-solid mass back into said vessel in countercurrent flow relative to the flow of said gaseous stream by rotating said spiral-shaped element.

DETAILED DESCRIPTION OF THE INVENTION AND PREFERRED EMBODIMENTS

One objective of the present invention is to provide a process and apparatus for reducing the solid particulate content in a gaseous stream containing entrained solid particulate matter and condensable hydrocarbons.

Another objective of the present invention is to reduce the clogging and plugging of the vaporous effluent discharge conduits from gasification vessels, particularly retorting vessels.

Another objective of the present invention is to increase the yield and quality of the normally condensable hydrocarbon oils obtained from retorting hydrocarbon-containing solids.

The term "hydrocarbon-containing solid" as used herein includes oil shales, oil sands, coal, tar sands, gilsonite, mixtures of two or more of these materials or any of the hydrocarbon-containing solids with inert materials, etc.

The terms "normally condensable hydrocarbons" or "condensable hydrocarbons" as used herein mean hydrocarbons which are condensable at standard temperature (25° C) and pressure (1 atmosphere).

The term "gasification" as used herein includes any process wherein hydrocarbon-containing solids are converted at least in part to a gaseous stream containing condensable hydrocarbons, particularly including coal gasification processes and shale retorting processes. The vaporous stream may contain entrained liquid hydrocarbon droplets.

The process and apparatus of the present invention will generally be described with reference to the retorting of shale. However, the process and apparatus of the present invention can also be used in processes for the gasification of other hydrocarbon-containing solids as defined above.

The process of the present invention is best understood with reference to the accompanying figures.

Figure 1:
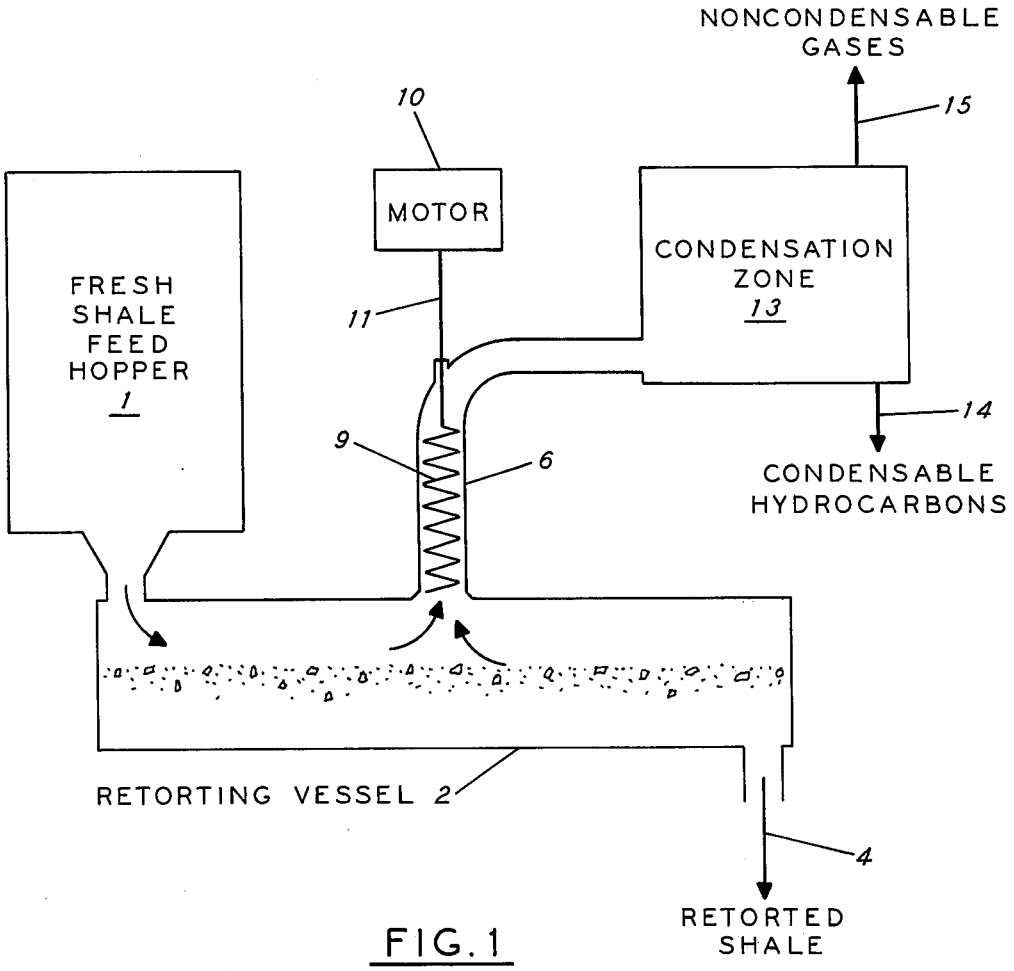
FIG. 1 illustrates one embodiment of the invention with a spiral-shaped conveying element inserted in the gaseous discharge conduit of a retorting vessel.

Referring now to FIG. 1, hydrocarbon-containing solids are transported from storage hopper 1 and introduced into gasification vessel 2, by any suitable means, for example by using a star feeder or an auger-like conveyor. In the gasification vessel, the solid is gasified or retorted by heating the solids to an elevated temperature typically in the range 800° to 1100° F or higher for shale. If desired, reactive gases such as steam, oxygen, or hydrogen may be used in gasifying the solid as is well known in the art. The hydrocarbon-containing solids can be heated by any of numerous means including external heating of the vessel or direct heating of the solids using heated or reactive gases or other solids. After a sufficient residence time in the gasification vessel, spent shale or other residual ungasified solids are removed from the vessel via line 4 by any suitable means, for example by gravity or use of an auger-like conveyor.

As the hydrocarbon-containing solids are gasified, a substantially vaporous hydrocarbon stream containing condensable hydrocarbons is formed and removed from the vessel via conduit 6. Generally, the gasification of the solid will produce sufficient pressure to force the gases out of the vessel; however, a stripping gas or other reactive gases may be forced through the vessel to entrain and transport the gaseous and any liquid hydrocarbons formed in the vessel.

Particulate matter is entrained in the effluent stream. This particulate matter generally comprises finely-divided portions of the hydrocarbon-containing solids and can vary widely in size from 0.001 to 0.1 inch and more commonly 0.001 to 0.01 inch in diameter. The quantity and size of the entrained particulate matter will of course depend on numerous factors such as the amount of fines introduced into or formed in the vessel and the velocity of the effluent stream.

As the effluent stream passes through conduit 6 at least a portion of the condensable hydrocarbons and the entrained particulate matter coalesces forming a semi-solid mass. This coalescence of hydrocarbons and particulate matter can result from condensation of a portion of the hydrocarbons in the conduit, or can result from coalescence of a portion of the particulate matter and entrained liquid hydrocarbon droplets formed in the vessel.

Rotatably positioned in outlet conduit 6 is a spiral-shaped element 9, connected by shaft 11 to a means for rotation, such as electric motor 10. The spiral-shaped element is rotated in a direction such that the thrust of the element forces the semi-solid mass of accumulated solids back into the vessel.

The rotating spiral-shaped element serves many important functions: First, it has been found that the particulate matter entrained in the effluent stream serves as nuclei for coalescence and condensation of a portion of the hydrocarbons. The rotation of the spiral impedes the flow of material through the conduit and increases the contacting of the entrained solid particulate matter and the condensed hydrocarbons resulting in the coalescence of particulate matter and condensed hydrocarbons and the formation of a semi-solid mass. Secondly, the rotating spiral prevents the clogging of the conduit by constantly conveying the accumulated semi-solid mass back into the gasification vessel. Thirdly, the spiral significantly increases the quality of the product condensed hydrocarbons by substantially reducing the particulate content in the oil. Fourthly, the spiral serves the important purpose of increasing the yield of condensed hydrocarbons by forcing the accumulated semi-solid mass back into the retorting vessel for further processing and eventual recovery of the hydrocarbon content of the semi-solid mass.

After passing through conduit 6, the effluent stream passes into condensation zone 13 wherein the stream is separated into condensable hydrocarbon fraction 14 and a non-condensable fraction 15.

The spiral-shaped element can have various shapes. What is essential is that the spiral impedes the flow of solids through the conduit and simultaneously collects and conveys the accumulated semi-solid mass back into the vessel. Preferably, the spiral is rotated at a speed sufficient to transport the semi-solid mass back into the vessel at a velocity of 0.1 to 0.5 feet per second. Preferably the spiral comprises a hollow core flexible helical-shaped element having a uniform diameter. Less preferred is a screw-like conveyor comprising a solid shaft with a spiral flange attached thereto, shaped so as to force the accumulated mass back into the retort. Preferably, however, the spiral-shaped element does not contain a rigid shaft, but rather consists of an elongated flexible spiral. The spiral can be made of any suitable material, but preferably it is made of metal which best withstands the high temperatures of the effluent gases, and also for the desired flexibility as is described more particularly in reference to FIG. 2. Preferably, the spiral is sized to fit rather loosely inside of the conduit. Typically, the diameter of the spiral may be only three-fourths or less of the diameter of the conduit. The length of the spiral and the number of coils, and the pitch of the coils can vary greatly depending on many factors, for example, the velocity of stream passing through the conduit, the solids content of the stream, and the speed of rotation of the spiral. Typically, the spiral may be from 1 to 10 feet long or longer and may have one to 100 or more coils. The rotation speed of the spiral can vary greatly depending on many interrelated factors. Generally, the speed of rotation will be in the range 1 to 1000 revolutions per minute and preferably 10 to 30 revolutions per minute. As is apparent to any person skilled in the art, these parameters and others can be varied widely to obtain the desired result. It is furthermore readily apparent that the retorting vessel can contain more than one effluent conduit containing the spiral.

Various types and configurations of gasification vessels known in the art are suitable for use in the present invention. For example, the present invention can be used with any vertical, inclined or horizontal gasification vessel with a vaporous effluent stream containing condensable hydrocarbons and entrained particulate matter.

The amount of solids removed from the effluent stream will vary greatly depending on many factors including the shape of the spiral and the amount of solids entrained in the effluent stream. Typically, the solids content of the effluent stream can be reduced by 20 to 60% or more using the process of the present invention.

A particularly preferred process for retorting shale wherein the present invention is useful is disclosed in my copending application, Ser. No. 700,378 entitled: "Retorting Process", the entire disclosure of which is incorporated herein by reference.

Figure 2:
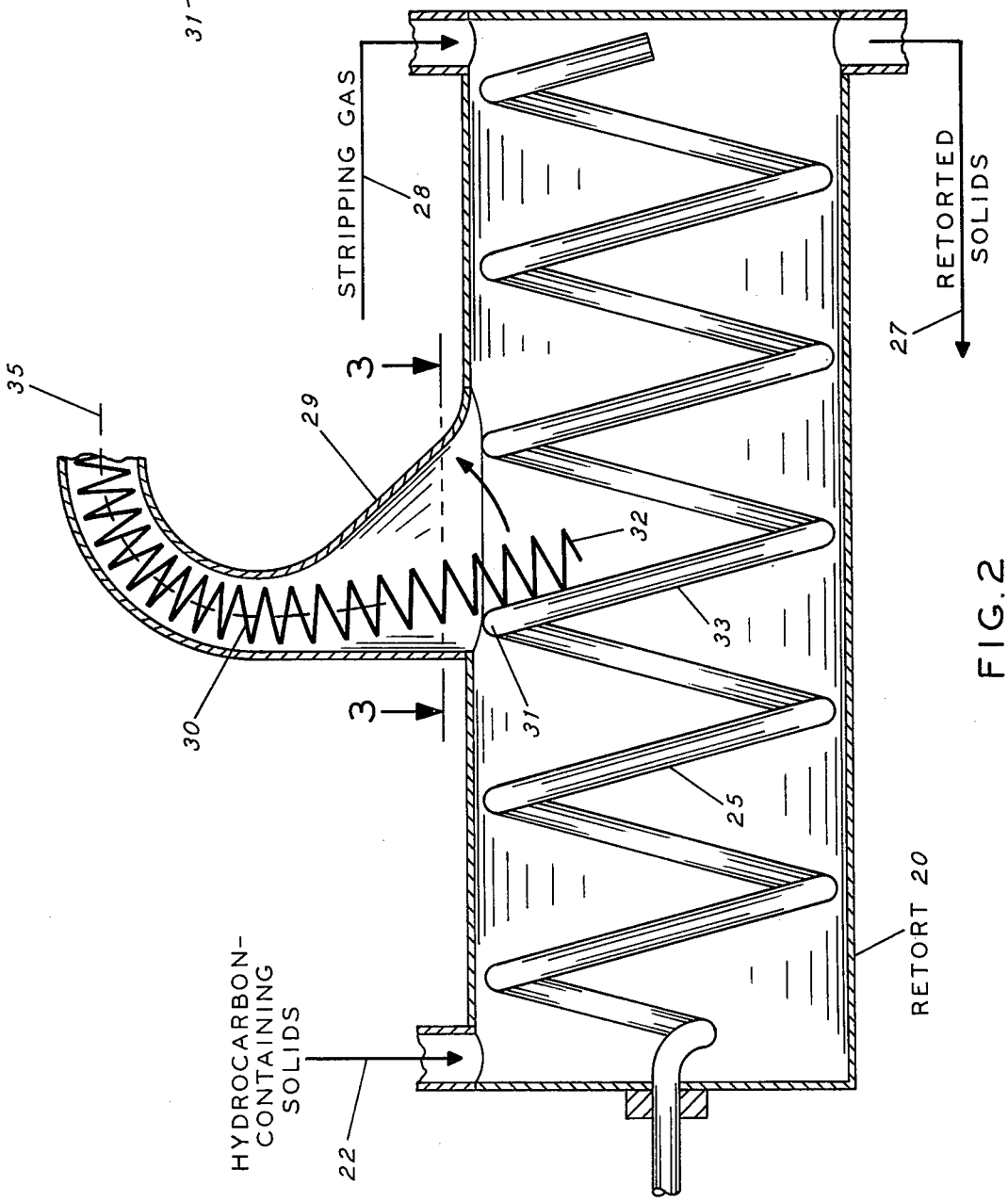
FIG. 2 illustrates a second preferred embodiment of the invention wherein a helical-shaped conveyor is used in a retorting vessel to transport solids through the retorting vessel and a spiral-shaped element is rotatably positioned in the vaporous discharge conduit of the retort. The spiral extends sufficiently far into the vessel to contact one coil of the helical-shaped conveyor.

Referring now to FIG. 2 which illustrates a preferred embodiment of the process and apparatus of the present invention. Hydrocarbon-containing solids and a solid heat transfer material heated to an elevated temperature are fed into the retort 20 via inlet 22. In this preferred embodiment of the invention both solids are conveyed from one end of the retort to the other end via an elongate spiral or helical-shaped conveyor 25 rotatably positioned in the vessel and connected to conventional rotational driving means not shown. The retorted solids are removed from the retort by conventional means via line 27. A stripping gas is fed into the end of the retort via line 28.

In this preferred embodiment of the invention, the spiral 30, comprises a flexible elongate, coiled spring-like element which is rotatably positioned in conduit 29 and extends sufficiently far into the vessel to make contact with at least one coil of conveyor 25. As conveyor 25 rotates, the end of the spiral 32 bends away from the end of the conveyor as shown by the arrow. As the spiral 30 clears the top edge 31 of the coil, the spiral springs back making contact with the next coil on the conveyor or the wall of the conduit. The end of the conduit is enlarged as shown to provide for this bending of the spiral.

Figure 3:
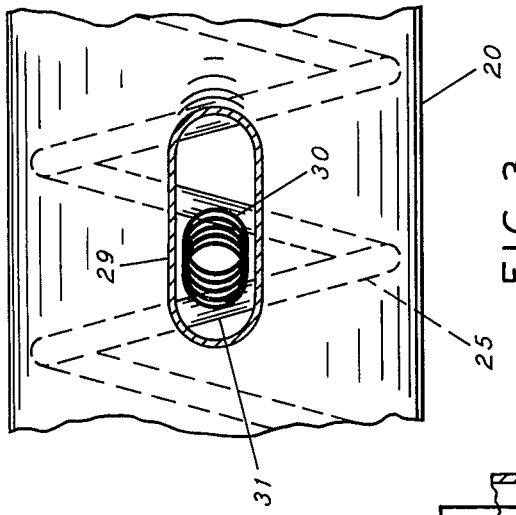
FIG. 3 is a cross section of a portion of the apparatus shown in FIG. 2.

FIG. 3 is a cross-sectional top view of the outlet conduit 29 on line 3-3 as marked in FIG. 2.

Other shapes for conduit 29, can readily be designed by any person skilled in the art, to provide for the bending of the end of the spiral. For example, conduit 29 can be shaped so that as conveyor 25 rotates the spiral bends and moves around the side-edge 33 of the coil rather than the top-edge 31.

The contact of the spiral with conveyor 25 serves an important purpose. After a period of time a deposit may build up on the spiral which is not removed by the rotary action of the helix. The contact of the end-portion 32 of the spiral with conveyor 25 results in a constant bending of the end section of the spiral which tends to break off any solid deposits. The solid deposits then drop back into the retort or are conveyed back into the retort by the rotating spiral.

Although the contact of the spiral with the conveyor 25 effectively prevents build-up of solids on the end of the spiral, deposits may still tend to accumulate on other portions of the spiral, thus reducing its efficiency. This problem, however, can be solved by shaping the conduit such that the spiral has a longitudinal bend to it such that a line passing through the center of the spiral forms an arcuate path as shown for example by line 35 in FIG. 2. Preferably, the outlet conduit has such a continuous bend for the entire length of the spiral. With this bend in the conduit, the rotation of the spiral also causes the spiral to be constantly flexing which tends to break off any carbonaceous deposits from the spiral. Thus, with the flexing of the end of the spiral due to the contact with conveyor in the retort coupled with the flexing of the spiral due to the rotation of the spiral through the bend in the conduit, the spiral can continue to serve its purpose in essentially continuous operation with but a minimal build-up of solids.

What is claimed is:

1. In a continuous process for extracting condensable hydrocarbons from hydrocarbon-containing solids including heating said solids in a vessel to form gaseous condensable hydrocarbons and withdrawing from said vessel a gaseous stream including said gaseous condensable hydrocarbons and entrained solid particulate matter, the improvement comprising: removing particulate matter from said stream by passing said stream through a longitudinally curved conduit communicating with said vessel, said curved conduit having rotatably positioned therein a flexible hollow-core elongated spiral element, whereby a portion of said gaseous condensable hydrocarbons are condensed and a semi-solid mass including the resulting condensed hydrocarbons and particulate matter is coalesced, in said conduit, and conveying at least a portion of said mass into said vessel by rotating said element.

2. An improved process according to claim 1 wherein said hydrocarbon-containing solids comprise shale.

3. An improved process according to claim 1 wherein said spiral element is rotated at a speed sufficient to transport said semi-solid mass at a velocity of 0.1 to 0.5 feet per second.

4. An improved process according to claim 1 wherein said hydrocarbon-containing solids are conveyed through said vessel by rotating a helical-shaped conveyer rotatably positioned in said vessel, and said flexible spiral element extending into said vessel sufficiently so that said spiral element is moved by motion of said conveyor upon rotation of said conveyor.

5. Apparatus for extracting condensable hydrocarbons from hydrocarbon-containing solids by retorting, including in combination:

a vessel;

means for introducing hydrocarbon-containing solids into said vessel;

means for removing residual solids from said vessel;

means for removing from said vessel a gaseous stream containing condensable hydrocarbons and entrained solid particulate matter, including a longitudinally curved conduit communicating with the interior of said vessel;

a flexible hollow core elongate spiral element rotatably positioned in said curved conduit for conveying a coalesced semi-solid mass of condensed hydrocarbons and said particulate matter back into said vessel; and means for rotating said spiral element.

6. Apparatus according to claim 5 wherein said spiral element is a flexible elongated coil spring.

7. Apparatus according to claim 5 further including an elongate helical-shaped conveyer rotatably positioned in said vessel for moving said solids through said vessel, said flexible spiral element extending into said vessel sufficiently so that said spiral element is moved by motion of said conveyer upon rotation of said conveyer.

* * * * *